US006484657B1

(12) United States Patent
Donovan et al.

(10) Patent No.: US 6,484,657 B1
(45) Date of Patent: Nov. 26, 2002

(54) ENVIRONMENTAL CONTROL SYSTEM FOR USE IN COMBINATION WITH CEILING HATCH

(76) Inventors: Burnell Donovan, 335 Greenleaf Ave., Wilmette, IL (US) 60091; Burton L. Hinman, 360 Oak Knoll Rd., Barrington, IL (US) 60010

( * ) Notice: Subject to any disclaimer, the term of this patent is extended or adjusted under 35 U.S.C. 154(b) by 0 days.

(21) Appl. No.: 09/880,479

(22) Filed: Jun. 13, 2001

(51) Int. Cl.[7] ..... B63B 19/12; E06B 7/16

(52) U.S. Cl. ..... 114/201 R; 49/476.1

(58) Field of Search ..... 114/361, 173, 114/177, 178, 201 R, 211, 227, 74 A; 49/476.1, 504; 52/209; 108/24–26; 105/377.07, 377.08; 296/213, 216.01

(56) References Cited

U.S. PATENT DOCUMENTS 663,172 A * 12/1900 Hoy ..... 114/120
1,664,116 A * 3/1928 Kortenhoeven ..... 105/377.07
2,994,452 A * 8/1961 Morrison ..... 114/74 A
3,092,854 A * 6/1963 Manhart ..... 441/38
3,475,772 A * 11/1969 Lokken ..... 114/361
3,730,120 A * 5/1973 Dobell ..... 114/256
3,779,198 A * 12/1973 Gray
3,834,340 A * 9/1974 Thorpe ..... 114/201 R
4,022,232 A * 5/1977 Ross et al.
4,112,645 A * 9/1978 Greenfield
4,227,737 A * 10/1980 Vogt ..... 296/76
4,363,350 A * 12/1982 Beckerer
4,385,580 A * 5/1983 Davidson
4,448,112 A * 5/1984 Soderberg ..... 114/211
4,537,147 A * 8/1985 Nivin
4,691,487 A * 9/1987 Kessler
4,706,593 A * 11/1987 Vail, Jr. ..... 114/211
4,729,584 A * 3/1988 Beckerer, Jr.
4,941,422 A * 7/1990 Muller
5,003,905 A * 4/1991 Raynor ..... 114/201 R
5,676,082 A * 10/1997 Kyle
5,768,834 A * 6/1998 Pinder
6,024,803 A * 2/2000 Buchanan et al. ..... 296/96.15

* cited by examiner

*Primary Examiner*—S. Joseph Morano
*Assistant Examiner*—Andrew Wright
(74) *Attorney, Agent, or Firm*—Christopher J. Scott; Charles F. Meroni, Jr.; Meroni & Meroni, P.C.

(57) ABSTRACT

The present invention discloses a system for controlling environmental conditions in connection with ceiling hatch use particularly on watercraft. The invention generally comprises a suspended support platform, a water diversion conduit cooperatively associated with a water exhaust aperture in the platform, and a water collection and containment structure for collecting and containing fresh water. The platform is suspended from a watercraft hatch for capturing and diverting water away from the watercraft hatch, yet allows continual airflow, heat exchange and filtered light to enter the hatched cabin. The platform is suspended so as to allow for easy removal of the platform from the path of egress through the watercraft. Manually adjustable baffle structures may be included at the perimeter of the platform to allow for prevention of wind blown rain from escaping the platform through the opening between the water collection receptacle and the underside of the watercraft deck.

38 Claims, 4 Drawing Sheets

ENVIRONMENTAL CONTROL SYSTEM FOR USE IN COMBINATION WITH CEILING HATCH

BACKGROUND OF THE INVENTION

1. Field of the Invention

The present invention relates to a system for controlling environmental conditions in connection with ceiling hatch use, and more particularly, to a system for controlling the ingress and egress of airflow, heat, light, and matter in connection with ceiling hatch use on watercraft.

2. Description of the Prior Art

Watercraft art is ancient. Watercrafts have been used for leisure, sport and livelihood for ages and those who have followed such pursuits have continually endeavored to improve upon their respective water borne vessel. Myriad accessories are available to watercraft enthusiasts for improving upon the watercraft experience. Notably, among the myriad watercraft accessories available, ceiling hatches for controlling the climate of watercraft cabins are often viewed as an essential feature to any water going vessel having an enclosed space for occupancy.

The marketplace for hatch accessories, in particular, has provided a lucrative niche for manufacturers of marine-oriented products. Conspicuously absent from the marketplace is a product enabling consumers the opportunity to outfit a watercraft with a simple system for comprehensively controlling environmental conditions attendant to hatch use. More specifically, a product is needed that allows occupants of hatched cabins to leave hatches open during wet weather, thus allowing continual airflow, heat exchange and filtered light to enter the hatched cabin during wet weather, while capturing otherwise airborne water entering the hatched cabin, preventing captured water from damaging the interior, and diverting captured water away from the hatch for further use and/or disposal thereof. Systems for controlling isolated environmental conditions attendant to hatch use such as those outlined above are known in the prior art and some are described hereinafter.

U.S. Pat. No. 4,022,232, which issued to Ross et al., discloses an Inverted Cargo Hatch Tent. This patent teaches a system for diverting water away from the contents of a cargo hold having a cargo hatch having exemplary rectangular coaming dimensions in the range of 30×40 feet to 60×85 feet. The system includes an inverted pliable sloping liner having an apex, which is the point where water accumulates under gravitational attraction. A drain line communicates with the apex to divert water away from the surface of the liner and the underlying cargo. The liner is contiguously mounted between the cargo hatch cover and the hatch coaming, enabling the system to collect water and divert water coming in contact with the sloped liner. Due to the snug liner mounting to the cargo hatch coaming, this system does not allow for unobstructed airflow to and from the cargo hold. Further, this system does not allow for heat to readily escape from the cargo hold. Still further this system does not allow for light to readily penetrate the cargo hold. Still further this system does not allow occupants to easily escape through the hatch as a path of egress in the event of the necessity to do so. The Inverted Cargo Hatch Tent thus blocks light and water and other airborne matter from entering or exiting the cargo hatch. The system thus effectively shields the applicable cargo hatch, but does not allow for free airflow and heat exchange, thus detracting from its capability to comprehensively control environmental conditions attendant to the use of ceiling hatches in occupancy based applications.

U.S. Pat. No. 4,385,580, which issued to Davidson, discloses a Marine Door Unit. This patent teaches a marine door system wherein the frame portion of the marine door unit includes water collection and diversion channels for diverting water away from watercraft gear and equipment storage compartments to which the marine door unit is attached. A drain tube further diverts collected water away from the compartment. A door is hingably connected to the frame portion, thus allowing entry into the storage compartment. The frame includes a support rail, which supports a sealing gasket for further sealing the marine door unit when the door is closed. Water leakage past the gasket is collected and diverted through the channels and away from the unit via the drain tube. Due to the snug water seal cooperatively associate with door closure on the unit, this system does not allow for unobstructed airflow to and from the storage compartment. Further, this system does not allow for heat to readily escape from the storage compartment. Still further this system does not allow for light to readily penetrate the storage compartment. The Marine Door Unit thus blocks light and water and other airborne matter from entering or exiting the storage compartment, keeping the compartment dry for storage. The system effectively shields the applicable storage compartment from environmental conditions, but does not allow for free airflow and heat exchange, thus detracting from its capability to comprehensively control environmental conditions attendant to the use of ceiling hatches in occupancy based applications.

U.S. Pat. No. 4,941,422, which issued to Muller, discloses a Hatch Ventilator Awning For Boats. This patent teaches a waterproof awning, which can be unrolled from a compact state for storage and be securely affixed over a boat hatch as an aid to prevent water from entering the boat cabin below the boat hatch and for funneling air into the hatch opening for better boat cabin ventilation. This hatch ventilator awning for boats does not prevent wind blown water from entering the hatch via the open funnel end. Further, the awning is affixed over a boat hatch thus preventing occupants in the boat cabin from adjusting or removing the awning from below the deck of the boat. Still further, the awing does not allow for easy ingress and egress of occupants from the hatch in the event of an emergency. The awning, thus allows for free airflow and filtered light to enter the boat cabin, but allows wind blown water to enter the cabin and frustrates boat cabin occupants from adjusting or easily removing the awning from within the cabin. These features both detract from its ability to comprehensively control environmental conditions attendant to the use of a watercraft hatch and compromises occupant safety by thwarting easy removal of the awning from a critical path of egress.

U.S. Pat. No. 5,768,834, which issued to Pinder, discloses a Rain Shield. This patent teaches a shield for roof vents consisting of two hingedly connected panels. The first panel is integrally attached to a vent cap and has dimensions greater in magnitude than the vent cap, thus blocking rain from entering the vent. The second panel is adjacent the first panel with an end opposite the hinge joint connected to a slide means slidably engaged with tracks on the roof adjacent the vent. This rain shield does not prevent wind blown water from entering the vent blown from positions lateral to the rain shield. Further, the rain shield is affixed integral with a vent cap exterior to the living space below the vent, thus preventing occupants from adjusting or removing the rain shield from within the vented room. The rain shield, thus allows for free airflow and filtered light to enter the vented room, but allows wind blown water to enter the room and frustrates cabin occupants from adjusting or easily removing the rain shield from within the room. These features both detract from the ability of the Rain Shield to comprehensively control environmental conditions attendant to the use of an occupancy based application for a ceiling hatch and decreases ease of occupant use by requiring occupants to adjust or remove the rain shield from an exterior roof location. Additionally, the Rain Shield does not allow for the collection and containment of valuable fresh water for further marine vessel use.

None of the prior art discloses a system for use in combination with a hatch having a suspended water collection means allowing for simultaneous collection, diversion and containment of water, filtering of light, circulation of air, exchange of heat, and shield for the prevention of other foreign matter from entering a hatched cabin or hatched room. Further, none of the prior art discloses a system for use in combination with a hatch having a suspended water collection means, which may be easily adjusted or removed from its suspended overlapping disposition below the ceiling hatch by an occupant from within the cabin or room, thus allowing for easy ingress and egress through the ceiling hatch.

SUMMARY OF THE INVENTION

Accordingly, one objective of the present invention is to provide a system for comprehensively controlling environmental conditions in connection with the use of ceiling hatches in occupancy based applications. In this regard, an objective of the present invention is to provide a suspended support platform for allowing simultaneous collection, diversion and containment of water, filtering of light, circulation of air, exchange of heat, and shielding of other foreign matter from entering a hatched cabin or hatched room. Another objective of the present invention is to provide a suspended support platform, which may be easily adjusted or removed from a suspended overlapping disposition below a ceiling hatch by an occupant from within the hatched cabin or hatched room, thus allowing for easy ingress and egress through the ceiling hatch as desired by room occupants. Yet another objective of the present invention is to provide a suspended support platform to enhance occupant privacy in a cabin. Still another objective of the present invention is to provide a suspended support platform to deter passersby from entering a hatched cabin or hatched room through a ceiling hatch.

To attain these objectives, the claimed invention generally comprises in combination a ceiling hatch being spatially and fixedly positioned in a substantially horizontal plane of a cabin or room ceiling. The ceiling hatch is positioned in a cabin or room ceiling adjacent to support structure corresponding to a cabin or room ceiling structure. The cabin or room ceiling structure adjacent the ceiling hatch further has bracket fastening means receiving structure. The ceiling hatch has pre-selected horizontal hatch size dimensions as selected by those desirous of a ceiling hatch.

The environmental control system further comprises a platform suspended below the ceiling hatch and adapted to support matter inferior to the ceiling hatch. The platform further comprises a substantially planar portion having an upper support surface and a lower exposed surface. The upper support surface faces opposite the ceiling hatch and the lower exposed surface faces a floor surface opposite the ceiling hatch. The platform also comprises an upwardly extending contiguous hem flange about the perimeter of the planar portion having an inner retaining surface and an outer exposed surface. The hem flange includes at least one liquid outlet aperture for exhausting liquid from the upper support surface and through the inner retaining and outer exposed surfaces.

The environmental control system further comprises at least one suspension means for suspending the platform below the ceiling hatch. The suspension means has at least one spatially superior attachment structure and at least one spatially inferior attachment structure opposite the spatially superior attachment structure. The spatially superior attachment structure is attached to the support structure adjacent the ceiling hatch and the spatially inferior attachment structure is attached to the platform.

The environmental control system further comprises at least one liquid conduit structure for diverting liquid away from the platform. The liquid conduit structure has one liquid inlet end and at least one liquid outlet end opposite the liquid inlet end. The liquid inlet end is cooperatively associated with the liquid outlet aperture for receiving exhausted liquid from the liquid outlet aperture.

The environmental control system comprises at least one liquid collection and containment structure for receiving and containing exhausted water. The liquid collection and containment structure includes at least one liquid receiving aperture. The liquid receiving aperture is cooperatively associated with the liquid outlet end for receiving exhausted liquid from the liquid outlet end.

Other claimed features of the environmental control system include baffle means supported at the perimeter of the platform and manually adjustable for preventing wind blown rain from escaping the platform through the opening between the platform and the underside of the ceiling hatch.

BRIEF DESCRIPTION OF THE DRAWINGS

Other features of our invention will become more evident from a consideration of the following detailed description of our patent drawings, as follows.

DETAILED DESCRIPTION OF THE INVENTION

Preferred Embodiment

Figure 1:
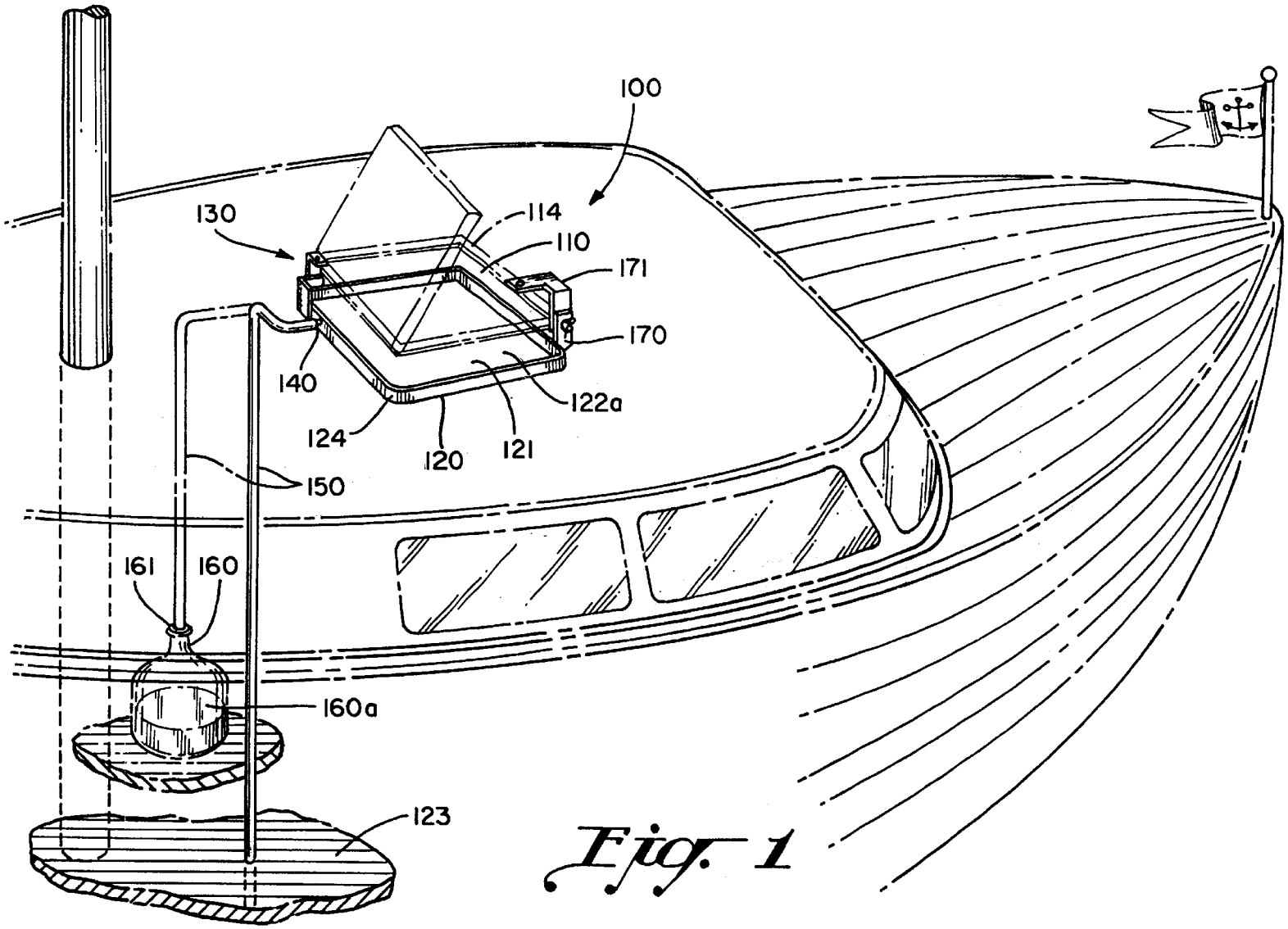
FIG. 1 is a perspective view of the preferred embodiment of the environmental control system.
Figure 2:
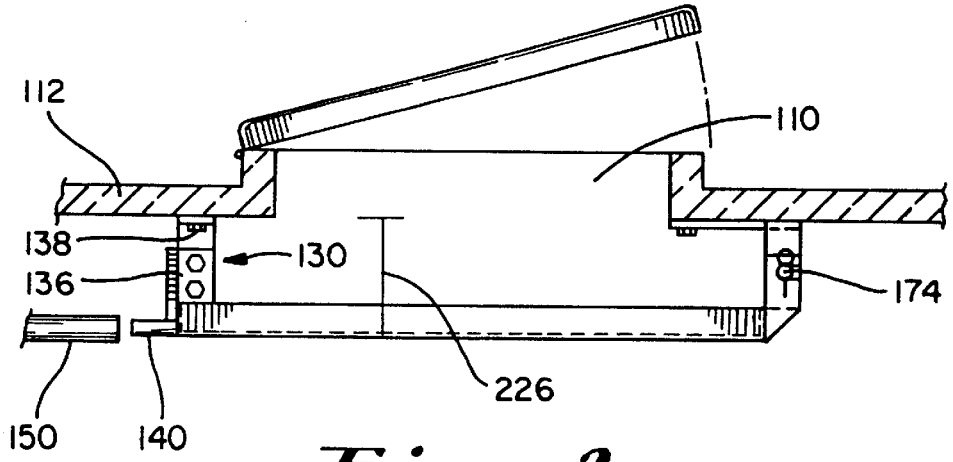
FIG. 2 is a fragmentary side view of the preferred embodiment of the environmental control system.
Figure 8:
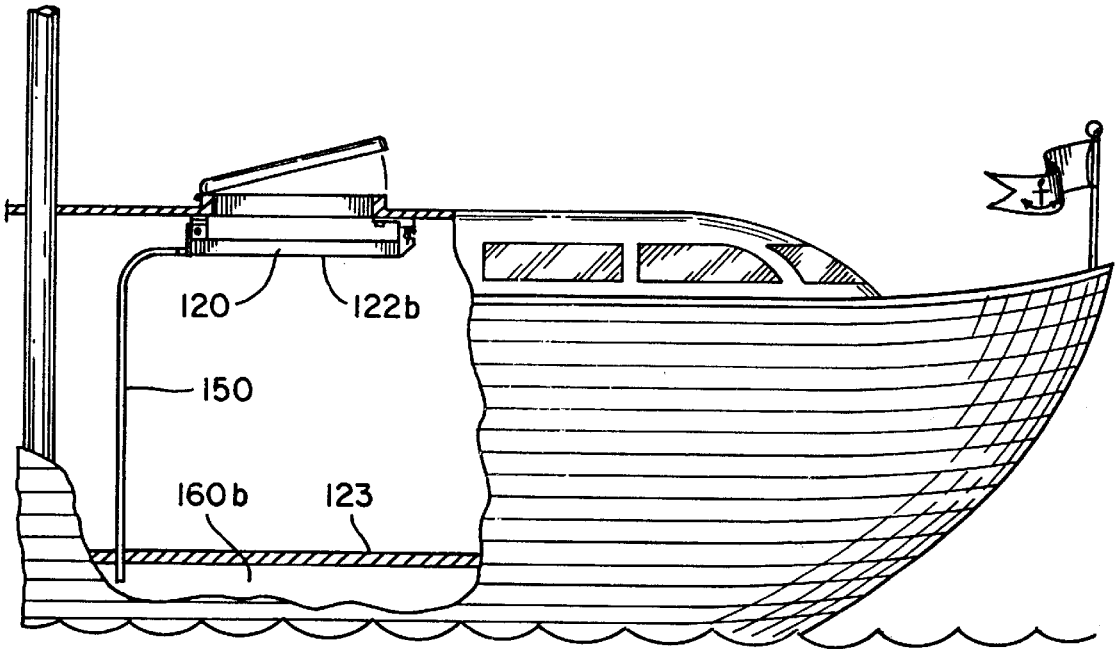
FIG. 8 is a fragmentary side view of the preferred embodiment of the environmental control system.

Referring now to the drawings, the preferred embodiment of the environmental control system 100 is generally illustrated in FIG. 1 (perspective view), FIG. 2 (fragmentary side view) and FIG. 8 (side view). The preferred embodiment of environmental control system 100 generally comprises in combination, a watercraft hatch 110, a platform 120, a suspension means, namely, a hinge assembly 130, a conduit union 140, a water diversion tube 150, and a water collection and containment structure 160.

Figure 3:
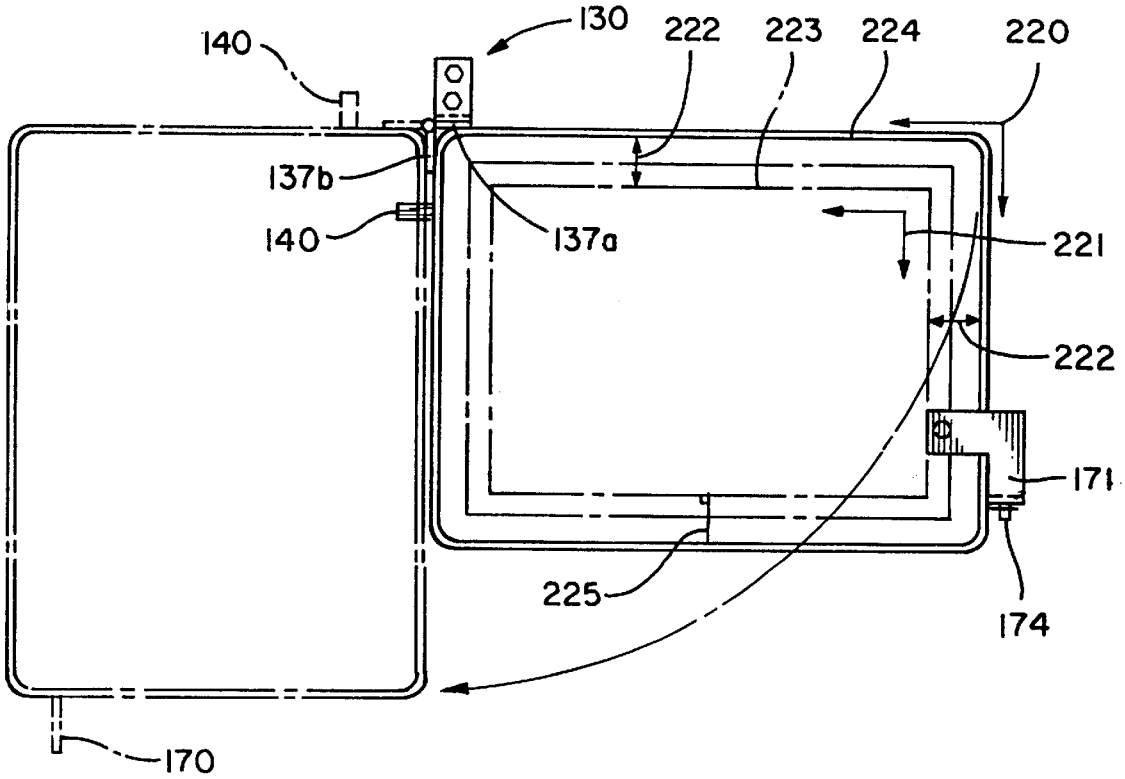
FIG. 3 is a fragmentary top plan view of the preferred embodiment of the environmental control system.

Watercraft hatch 110 as shown in FIG. 1, FIG. 2 and FIG. 3 is spatially and fixedly positioned in a substantially horizontal plane of a cabin or room ceiling. Watercraft hatch 110 is positioned in a cabin or room ceiling adjacent to support structure 112 which corresponds to a cabin or room ceiling support structure. Support structure 112 must be capable of receiving and securing holding bracket fastening means 138. Watercraft hatch 110 may include a frame portion 114 and frame portion 114 may provide an added support structure for receiving bracket fastening means 138. Watercraft hatch 110 is constructed having pre-selected hatch perimeter dimensions 221 as selected by the consumer desirous of incorporating a watercraft hatch into a boat.

The environmental control system further consists of platform 120 being suspended below watercraft hatch 110 as shown in FIG. 1, FIG. 2 and FIG. 8. Platform 120 is adapted to support matter inferior to watercraft hatch 110 and is constructed of a strong rigid material such as plastic, fiberglass, wood, or metal. Stainless steel is the preferred material as it is both rust-resistant and difficult to penetrate by would-be passersby intent on entering a hatched cabin or hatched room uninvited. Platform 120, when made of metal may be machine pressed into the desired configuration. Platform 120 must further be capable of receiving and securely holding platform fastening means.

Figure 4:
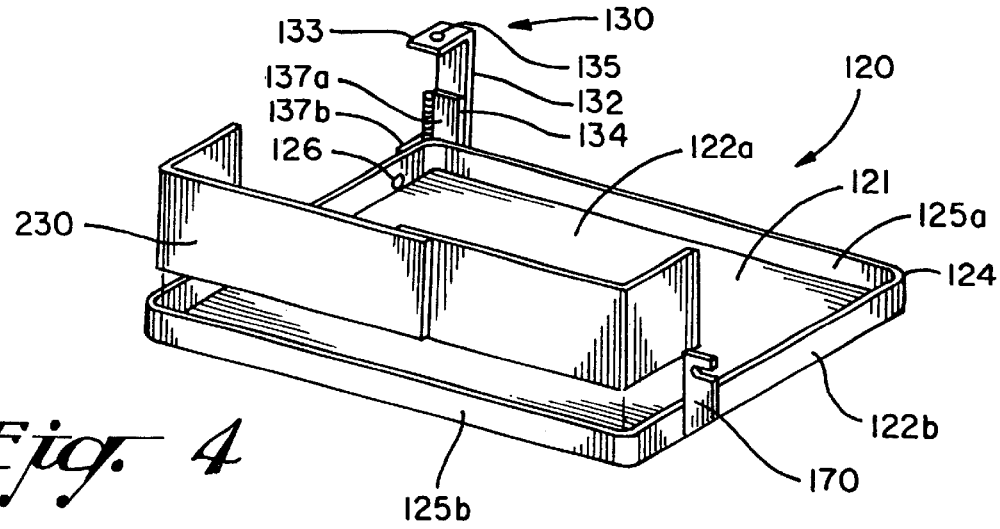
FIG. 4 is a fragmentary exploded perspective view of the preferred suspension means, platform and one exemplary orientation of the baffle means.

Platform 120 further comprises a planar portion 121 as shown in FIG. 1 and FIG. 4 and has an upper support surface 122(*a*) and a lower exposed surface 122(*b*) as shown in FIG. 8. Upper support surface 122(*a*) faces opposite watercraft hatch 110 and lower exposed surface 122(*b*) faces a floor surface 123 opposite watercraft hatch 110 as further shown in FIG. 1 and FIG. 8. Planar portion 121 preferably lies in a plane substantially parallel to the plane in which watercraft hatch 110 lies. Planar portion 121 has pre-selected hem perimeter dimensions 220 of greater magnitude than pre-selected hatch perimeter dimensions 221 such that the difference therebetween results in a suspended margin of perimeter overlap 222 as shown in FIG. 3. Suspended margin of perimeter overlap 222 has an inner perimeter 223 and an outer perimeter 224. The perpendicular distance 225 between inner perimeter 223 and outer perimeter 224 is preferably substantially constant. This means that watercraft hatch 110 is the same shape as platform 120, but smaller in size, and spatially positioned such that suspended margin of overlap 222 has an equal thickness on all sides.

The pre-selected hem perimeter dimensions 220 may be dependent on the distance 226 between the plane in which 120 planar portion lies and the plane in which watercraft hatch 110 lies as shown in FIG. 2. A substantially positive correlation preferable exists between perpendicular distance 225 and distance 226. The substantially positive correlation preferably varies in about a one unit to one unit ratio. In the case of a positive correlation between two variables, high measurements on one variable tend to be associated with high measurements on the other variable and low measurements on one variable with low measurements on the other. In other words, the two variables vary together in the same direction. A substantially positive correlation is one in which the difference between pairs of variables is always the same.

It is anticipated that distance 226 may be pre-selectively chosen from a range between about 7.62 cm and about 15.24 cm, the preferred distance 226 being about 10.16 cm. This distance is chosen as a compromise. In rooms where headroom is limited, as is normally the case on watercraft, space must be conserved when suspending bulky structures from overhead. Distances of greater magnitude than those here cited tend to result in an unwieldy platform. Planar portion 121 is preferably rectangular shaped, the four corners of planar portion 121 preferably being rounded as shown in FIG. 1, FIG. 3 and FIG. 4. The preferred radius of the rounded comers is about 2.54 cm. Rounded corners are useful, particularly in preferred scenarios where stainless steel is being used as platform material. The combination of a low ceilings and sharp rigid corners raises safety concerns, thus giving rise to a preferred rounded corner.

Platform 120 also has an upwardly extending contiguous hem flange 124 about the perimeter of planar portion 121 having an inner retaining surface 125(*a*) and an outer exposed surface 125(*b*) as shown in FIG. 1 and FIG. 4. Hem flange 124 has at least one water outlet aperture 126 for exhausting water from upper support surface 122(*a*) and through inner retaining surface 125(*a*) and outer exposed surface 125(*b*). Hem flange 124 preferably has an upwardly extended height dimension of about 5.08 cm. This dimension serves to better retain water from spilling over hem flange 124, yet allow occupants to manually adjust matter, which may be supported on platform 120.

The environmental control system generally further comprises at least one suspension means for suspending platform 120 below watercraft hatch 110. The suspension means must have at least one spatially superior attachment structure and at least one spatially inferior attachment structure opposite the spatially superior attachment structure. The spatially superior attachment structure being attached to support structure 112 adjacent watercraft hatch 110 and the spatially inferior attachment structure must be attached to platform 120. The suspension means must have a releasable attachment structure embodied either in the spatially superior attachment structure or the inferior attachment structure so that platform 120 may be selectively moved from the path of egress provided by watercraft hatch 110. The path of egress is a serious safety concern and must be kept in mind when constructing various means for suspension. The suspension means also allows air, heat, light, and water to ingress and egress through watercraft hatch 110.

More specifically, the suspension means of the preferred embodiment of environmental control system 100 is further defined by hinge assembly 130 as shown in FIG. 1, FIG. 2, FIG. 3 and FIG. 4. Hinge assembly 130 is preferably located adjacent one corner of planar portion 121 such that the planes in which lie the adjacent two portions of hem flange 124 intersect at a hinge joint 131 as shown in FIG. 1. Hinge assembly 130 further comprises a rigid bracket member 132 having an upper flange portion 133 and a lower hinge attachment portion 134 opposite upper flange portion 133. Flange portion 133 has fastening means receiving structure 135 for secure attachment to support structure 112.

Hinge assembly 130 further comprises a hinge structure 136, such as a piano hinge, having a first rigid wing member 137(*a*) and a second rigid wing member 137(*b*). First rigid wing member 137(*a*) and second rigid wing member 137(*b*) are jointed about a substantially vertical axis of rotation running through hinge joint 131. First rigid wing member 137(*a*) is integrally attached to rigid bracket member 132 and second rigid wing member 137(*b*) has platform fastening means receiving structure for attachment to platform 120. For example, platform fastening means receiving structure may comprise bolt receiving apertures or be constructed of material capable of being welded to platform 120. Bracket fastening means 138 securely attach upper bracket member 132 to support structure 112 as shown in FIG. 3 or frame portion 114 as shown in FIG. 1. Platform fastening means securely attach second rigid wing member 137(*b*) to platform 120, thus allowing platform 120 to be spatially repositioned about the substantially vertical axis of rotation at least 90 rotational degrees for easy ingress and egress through watercraft hatch 110.

The preferred embodiment of the environmental control system 100 may also include as part of its preferred suspension means an upwardly extending positioning bracket 170 as shown in FIG. 1, FIG. 2, FIG. 4 and FIG. 5 integrally formed with platform 120 and a mounting bracket 171 as shown in FIG. 1 and FIG. 3. Mounting bracket 171 has a superior bracket end and an inferior bracket end. The superior bracket end is securely attached to support structure 112 adjacent watercraft hatch 110 at a point preferably diagonally opposite hinge assembly 130. The inferior bracket end has positioning bracket attachment means 174 for releasable attachment to positioning bracket 170 as shown in FIG. 2 and FIG. 3. Positioning bracket attachment means 174 is releasably attached to positioning bracket 170, thus allowing positioning bracket 170 to releasably retain platform 120 in position inferior to watercraft hatch 110. At the election of the occupant, the occupant need only release positioning bracket attachment means 174 and rotate platform 120 at least 90 rotational degrees about the substantially vertical axis of rotation to allow for easy ingress and egress through watercraft hatch 110 as shown in FIG. 3.

The preferred embodiment of environmental control system 100 further comprises at least one rigid tubular conduit union 140 for diverting water away from platform 120 as shown in FIG. 2 and FIG. 3. Conduit union 140 has one water inlet end and one tube-engaging end opposite the water inlet end. The water inlet end is integrally formed with hem flange 124 adjacent water outlet aperture 126. Conduit union 140 preferably extends laterally from outer exposed surface 125(*b*). This configuration is preferable to save headroom space and to eliminate a the possible safety concern of head injury by a downwardly extending structure.

The preferred embodiment of environmental control system 100 further comprises at least one flexible water diversion tube 150 for diverting water away from conduit union 140 as shown in FIG. 1, FIG. 2 and FIG. 8. Water diversion tube 150 has one conduit union-engaging end and at least one water outlet end opposite the conduit union-engaging end. The conduit union-engaging end is snugly engaged with the tube-engaging end. Conduit union 140 is preferably located adjacent hinge assembly 130. This configuration is preferable so that when platform 120 is pivoted about the substantially vertical axis of rotation, a shorter water diversion tube 150 may be utilized, thus conserving space. Water diversion tube 150 is preferably translucent to enable occupants to visually inspect the contents of water diversion tube 150.

The preferred embodiment of environmental control system 100 further comprises at least one water collection and containment structure 160 for receiving and containing exhausted water from upper support surface 122(*a*) as shown in FIG. 1. Water collection and containment structure 160 has at least one water receiving aperture 161 cooperatively associated with the water outlet end for receiving exhausted water from the water outlet end. Water collection and containment structure 160 may either take the form of a water jug 160(*a*) or similar liquid container as shown in FIG. 1 or a watercraft bilge 160(*b*) as shown in FIG. 1 and FIG. 8. In this manner, occupants may either collect and contain water in water jug 160(*a*) for sundry fresh water uses on watercraft or occupants may elect to divert fresh water to watercraft bilge 160(*b*) to freshen bilge water.

Figure 5:
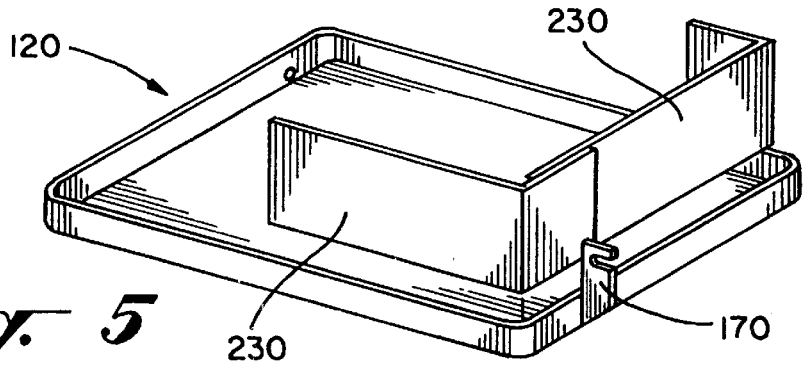
FIG. 5 is a fragmentary exploded perspective view of the support platform and an alternative exemplary orientation of the baffle means.

The environmental control system 100 may also comprise baffle means 230 as shown in FIG. 4 and FIG. 5. Manually adjustable baffle means 230 are supported generally at the perimeter of platform 120 with the bottom edge thereof being adapted to be engaged with planar portion 121 for preventing wind blown rain from escaping platform 120 through the opening between platform 120 and the underside of watercraft hatch 110. Baffle means 230 may be manually adjusted according to the direction of wind blown rain as desired by the occupant.

First Alternative Embodiment

The first alternative embodiment of the environmental control system is the same as the preferred embodiment of the environmental control system 100 save for the specific suspension means for suspending platform 120 below watercraft hatch 110 and required added structure being given to hem flange 124.

Figure 6:
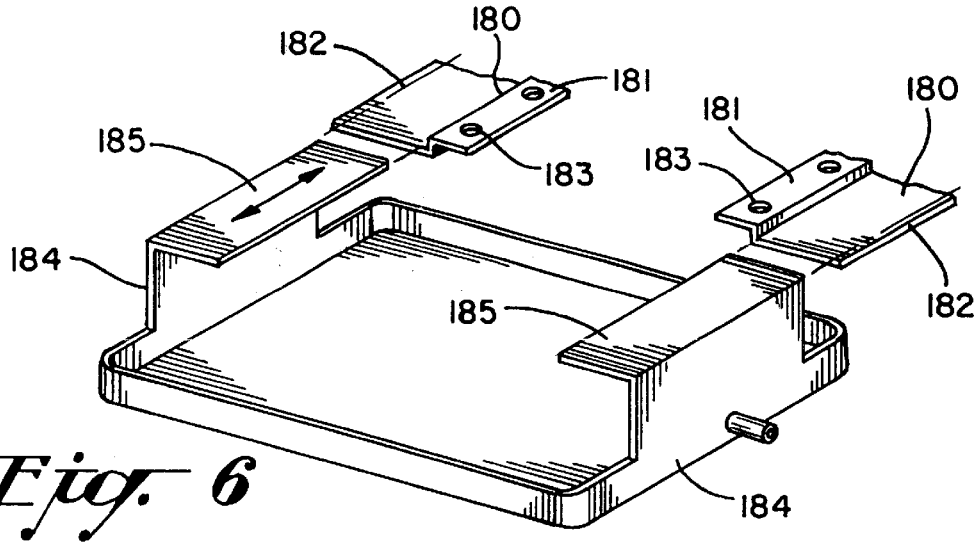
FIG. 6 is a fragmentary perspective view of an alternative suspension means and platform.

The suspension means of the first embodiment as shown in FIG. 6 is further defined by two laterally opposed mounting brackets 180, each mounting bracket having a superior mounting flange portion 181 and an inferior sliding flange receiving portion 182. Each superior mounting flange portion 181 has mounting bracket fastening means receiving structure 183 for secure attachment to support structure 112 adjacent watercraft hatch 110. Hem flange 124 has at least two oppositely aligned sliding flange portions 185 each being supported by one upwardly extending flange support wall 184. Flange support walls 184 are upward extensions of hem flange 124. Sliding flange portions 185 are releasably and slidably engaged with inferior sliding flange receiving portions 182, thus allowing platform 120 to be releasably and slidably positioned inferior to watercraft hatch 110. At the election of the occupant, the occupant need only slidably release platform 120 to allow for easy ingress and egress through watercraft hatch 110.

Second Alternative Embodiment

The second alternative embodiment of the environmental control system is the same as the preferred embodiment of the environmental control system 100 save for the specific suspension means for suspending platform 120 below watercraft hatch 110, required added structure being given to hem flange 124, additional support structure attachment means 115, platform fastening means receiving structure, and optionally a locking means to prevent platform 120 from sliding out of position under watercraft hatch 110.

Figure 7:
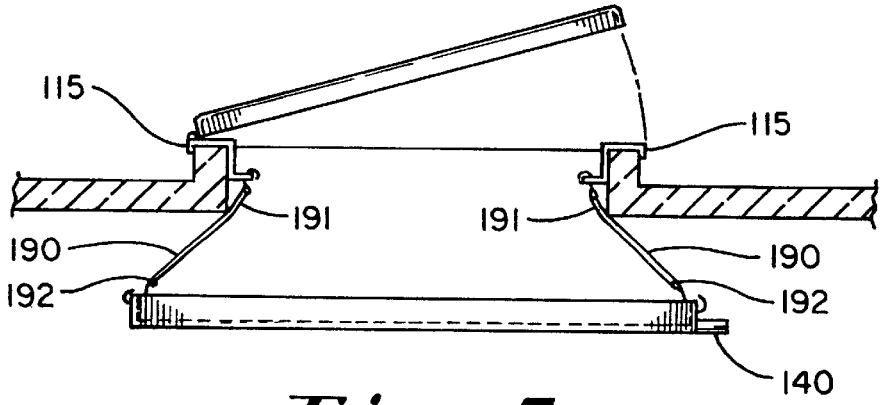
FIG. 7 is a fragmentary side view of an alternative suspension means, platform, and ceiling hatch.

The suspension means of the second embodiment as shown in FIG. 7 in which water craft hatch 110 has a watercraft hatch lid covering with hinge mechanism being omitted to allow depiction of support structure attachment means 115. The suspension means of the second embodiment is further defined by at least two flexible hanging members 190 located opposite one another. Each flexible hanging member 190 has a superior attachment end 191 and at least one inferior attachment end 192. Flexible hanging members 190 may comprise rope, chain, cord, straps and the like. Each superior attachment end 191 is releasable attached to support structure attachment means 115 for attachment to support structure 112 adjacent watercraft hatch 110. Support structure attachment means 115 are removably attached to support structure 112 adjacent watercraft hatch 110. Each inferior attachment end 192 has platform attachment means 194 for attaching each inferior attachment end 192 to platform 120. Platform attachment means 194 is removably attached to platform 120, thus allowing platform 120 to be releasably hung in position inferior to watercraft hatch 110 for easy ingress and egress through watercraft hatch 110 at the election of the occupant. Optionally, occupants may desire to include a locking means to prevent platform 120 from sliding out of position under watercraft hatch 110.

The reader will see that the preferred environmental control system provides a system for comprehensively controlling environmental conditions in connection with the use of ceiling hatches in occupancy based applications. In this regard, the present invention provides a suspended support platform for allowing simultaneous collection, diversion and containment of water, filtering of light, circulation of air, exchange of heat, and shielding of foreign matter from entering a hatched cabin or hatched room. The reader will further see that the present invention provides a suspended support platform, which may be easily adjusted or removed from a suspended overlapping disposition below a ceiling hatch by an occupant from within the hatched cabin or hatched room. This allows for easy ingress and egress through the ceiling hatch as desired by hatched cabin or hatched room occupants. The reader will further see that the present invention also provides a suspended support platform to enhance occupant privacy in a hatched cabin or hatched room. The reader will still further see that present invention also provides a suspended support platform to deter passersby from entering a hatched cabin or hatched room through a ceiling hatch, particularly when the platform is constructed from a strong rigid material such as stainless steel.

It is foreseen that the concepts herein described may be extended and applied to environmental control systems of the type herein described to ceiling hatches in all occupancy-based applications. The environmental control system herein illustrated and described is used primarily for descriptive and illustrative purposes and should not be construed to limit the scope of concept application to the application as shown. Accordingly, although the invention has been described by reference to some embodiments it is not intended that the novel device be limited thereby, but that modifications thereof are intended to be included as falling within the broad scope and spirit of the foregoing disclosure, the following claims and the appended drawings.

We claim:

1. An environmental control system for use in combination with a watercraft hatch comprising, in combination:

a watercraft hatch, the watercraft hatch being spatially and fixedly positioned in a substantially horizontal plane, said watercraft hatch being adjacent support structure, the support structure having bracket fastening means receiving structure, said watercraft hatch having preselected horizontal hatch size dimensions;

a platform, the platform being suspended below the watercraft hatch, said platform being adapted to support matter inferior to said watercraft hatch, said platform having platform fastening means receiving structure, said platform further comprising:

a planar portion, the planar portion having an upper support surface and a lower exposed surface, the upper support surface facing opposite said watercraft hatch, the lower exposed surface facing a floor surface opposite said watercraft hatch;

an upwardly extending contiguous hem flange about the perimeter of said planar portion; the hem flange having an inner retaining surface and an outer exposed surface, said hem flange having at least one water outlet aperture for exhausting water from said upper support surface through said inner retaining surface and said outer exposed surface;

a hinge assembly, the hinge assembly being located adjacent one corner of said planar portion such that the planes in which the adjacent two portions of said hem flange lie intersect at a hinge joint, the hinge assembly further comprising:

a rigid bracket member, the rigid bracket member having an upper flange portion and a lower hinge attachment portion opposite the upper flange portion, the flange portion having fastening means receiving structure for secure attachment to the support structure;

a hinge structure, the hinge structure having first and second rigid wing members, the first and second rigid wing members jointed about a substantially vertical axis of rotation, said first rigid wing member being integrally attached to said flanged member, said second rigid wing member having platform fastening means receiving structure for attachment to said platform;

bracket fastening means securely attaching upper bracket member to said superior support structure;

platform fastening means securely attaching said second rigid wing member to said platform, thus allowing said platform to be spatially repositioned about the substantially vertical axis of rotation at least 90 rotational degrees for easy ingress and egress through said watercraft hatch at the election of the occupant;

at least one rigid tubular conduit union for diverting water away from said platform, the conduit union having one water inlet end and one tube-engaging end opposite the water inlet end, said water inlet end being integrally formed with said hem flange adjacent the water outlet aperture, said conduit union extending laterally from said outer exposed surface;

at least one flexible water diversion tube for diverting water away from said conduit union, the water diversion tube having one conduit union-engaging end and at least one water outlet end opposite the conduit union-engaging end, said conduit union-engaging end being snugly engaged with the tube-engaging end; and at least one water collection and containment structure for receiving and containing exhausted water, the water collection and containment structure having at least one water receiving aperture, the water receiving aperture being cooperatively associated with the water outlet end for receiving exhausted water from said water outlet end.

2. An environmental control system for use in combination with a watercraft hatch comprising, in combination:

a watercraft hatch, the watercraft hatch being spatially and fixedly positioned in a substantially horizontal plane, said watercraft hatch being adjacent support structure, the support structure having bracket fastening means receiving structure, said watercraft hatch having preselected horizontal hatch size dimensions;

a platform, the platform being suspended below the watercraft hatch, said platform being adapted to support matter inferior to said watercraft hatch, said platform having platform fastening means receiving structure, said platform further comprising:

a planar portion, the planar portion having an upper support surface and a lower exposed surface, the upper support surface facing opposite said watercraft hatch, the lower exposed surface facing a floor surface opposite said watercraft hatch;

an upwardly extending contiguous hem flange about the perimeter of said planar portion; the hem flange having an inner retaining surface and an outer exposed surface, said hem flange having at least one water outlet aperture for exhausting water from said upper support surface through said inner retaining surface and said outer exposed surface;

at least two laterally opposed mounting brackets, each mounting bracket having a superior mounting flange portion and an inferior sliding flange receiving portion, each superior mounting flange portion having mounting bracket fastening means receiving structure for secure attachment to support structure adjacent said watercraft hatch;

at least one rigid tubular conduit union for diverting water away from said platform, the conduit union having one water inlet end and one tube-engaging end opposite the water inlet end, said water inlet end being integrally formed with said hem flange adjacent the water outlet aperture, said conduit union extending laterally from said outer exposed surface;

at least one flexible water diversion tube for diverting water away from said conduit union, the water diversion tube having one conduit union-engaging end and at least one water outlet end opposite the conduit union-engaging end, said conduit union-engaging end being snugly engaged with the tube-engaging end; and at least one water collection and containment structure for receiving and containing exhausted water, the water collection and containment structure having at least one water receiving aperture, the water receiving aperture being cooperatively associated with the water outlet end for receiving exhausted water from said water outlet end.

3. The environmental control system of claim 2 wherein said hem flange has at least two oppositely aligned sliding flange portions, each sliding flange portion being supported by an upwardly extending flange support wall, each flange support wall being an upward extension of said hem flange, the sliding flange portions being releasably and slidably engaged with the inferior sliding flange receiving portions, thus allowing said platform to be releasably and slidably positioned inferior to said watercraft hatch for easy ingress and egress through said watercraft hatch at the election of the occupant.

4. An environmental control system for use in combination with a watercraft hatch comprising, in combination:

a watercraft hatch, the watercraft hatch being spatially and fixedly positioned in a substantially horizontal plane, said watercraft hatch being adjacent support structure, the support structure having bracket fastening means receiving structure, said watercraft hatch having preselected horizontal hatch size dimensions;

a platform, the platform being suspended below the watercraft hatch, said platform being adapted to support matter inferior to said watercraft hatch, said platform having platform fastening means receiving structure, said platform further comprising:

a planar portion, the planar portion having an upper support surface and a lower exposed surface, the upper support surface facing opposite said watercraft hatch, the lower exposed surface facing a floor surface opposite said watercraft hatch;

an upwardly extending contiguous hem flange about the perimeter of said planar portion; the hem flange having an inner retaining surface and an outer exposed surface, said hem flange having at least one water outlet aperture for exhausting water from said upper support surface through said inner retaining surface and said outer exposed surface;

at least two flexible hanging members located opposite one another, each flexible hanging member having a superior attachment end and at least one inferior attachment end, each superior attachment end having support structure attachment means for attachment to support structure adjacent said watercraft hatch, the support structure attachment means being removably attached to support structure adjacent said watercraft hatch, each inferior attachment end having platform attachment means for attaching each inferior end to said platform, the platform attachment means being removably attached to said platform, thus allowing said platform to be releasably hung in position inferior to said watercraft hatch for easy ingress and egress through said watercraft hatch;

at least one rigid tubular conduit union for diverting water away from said platform, the conduit union having one water inlet end and one tube-engaging end opposite the water inlet end, said water inlet end being integrally formed with said hem flange adjacent the water outlet aperture, said conduit union extending laterally from said outer exposed surface;

at least one flexible water diversion tube for diverting water away from said conduit union, the water diversion tube having one conduit union-engaging end and at least one water outlet end opposite the conduit union-engaging end, said conduit union-engaging end being snugly engaged with the tube-engaging end; and at least one water collection and containment structure for receiving and containing exhausted water, the water collection and containment structure having at least one water receiving aperture, the water receiving aperture being cooperatively associated with the water outlet end for receiving exhausted water from said water outlet end.

5. An environmental control system for use in combination with a watercraft hatch comprising, in combination:

a watercraft hatch, the watercraft hatch being spatially and fixedly positioned in a substantially horizontal plane, said watercraft hatch being adjacent support structure, the support structure having bracket fastening means receiving structure, said watercraft hatch having preselected horizontal hatch size dimensions;

a platform, the platform being suspended below the watercraft hatch, said platform being adapted to support matter inferior to said watercraft hatch, said platform having platform fastening means receiving structure, said platform further comprising:

a planar portion, the planar portion having an upper support surface and a lower exposed surface, the upper support surface facing opposite said watercraft hatch, the lower exposed surface facing a floor surface opposite said watercraft hatch;

an upwardly extending contiguous hem flange about the perimeter of said planar portion; the hem flange having an inner retaining surface and an outer exposed surface, said hem flange having at least one water outlet aperture for exhausting water from said upper support surface through said inner retaining surface and said outer exposed surface;

at least one suspension means for suspending said platform below said watercraft hatch, the suspension means having at least one spatially superior attachment structure and at least one spatially inferior attachment structure opposite the spatially superior attachment structure, the spatially superior attachment structure being attached to support structure adjacent said watercraft hatch, the spatially inferior attachment structure being attached to said platform;

at least one rigid tubular conduit union for diverting water away from said platform, the conduit union having one water inlet end and one tube-engaging end opposite the water inlet end, said water inlet end being integrally formed with said hem flange adjacent the water outlet aperture, said conduit union extending laterally from said outer exposed surface;

at least one flexible water diversion tube for diverting water away from said conduit union, the water diversion tube having one conduit union-engaging end and at least one water outlet end opposite the conduit union-engaging end, said conduit union-engaging end being snugly engaged with the tube-engaging end; and at least one water collection and containment structure for receiving and containing exhausted water, the water collection and containment structure having at least one water receiving aperture, the water receiving aperture being cooperatively associated with the water outlet end for receiving exhausted water from said water outlet end.

6. The environmental control system of claim 5 wherein said planar portion lies in a plane substantially parallel to the plane in which said watercraft hatch lies.

7. The environmental control system of claim 6 wherein said planar portion has pre-selected hem perimeter dimensions of greater magnitude than the pre-selected hatch perimeter dimensions such that the difference therebetween results in a suspended margin of perimeter overlap, the suspended margin of perimeter overlap having an inner perimeter and an outer perimeter.

8. The environmental control system of claim 7 wherein the perpendicular distance between the inner perimeter and the outer perimeter is substantially constant.

9. The environmental control system of claim 8 wherein the pre-selected hem perimeter dimensions are dependent on the distance between the plane in which said planar portion lies and the plane in which said watercraft hatch lies.

10. The environmental control system of claim 9 wherein a substantially perfect positive correlation exists between the perpendicular distance between said inner perimeter and said outer perimeter and the distance between the plane in which said planar portion lies and the plane in which said watercraft hatch lies.

11. The environmental control system of claim 10 wherein the substantially perfect positive correlation varies in about a one unit to one unit ratio.

12. The environmental control system of claim 11 wherein the distance between the plane in which said planar portion lies and the plane in which said watercraft hatch lies is pre-selectively chosen from a range between about 7.62 cm and about 15.24 cm.

13. The environmental control system of claim 12 wherein the distance between the plane in which said planar portion lies and the plane in which said watercraft hatch lies is about 10.16 cm.

14. The environmental control system of claim 13 wherein said hem flange has a upwardly extended height dimension of about 5.08 cm.

15. The environmental control system of claim 11 wherein said planar portion is rectangular shaped, the four corners of said planar portion being rounded, the rounded corners having a radius of about 2.54 cm.

16. The environmental control system of claim 5 wherein said suspension means is further defined by a hinge assembly, the hinge assembly being located adjacent one corner of said planar portion such that the planes in which the adjacent two portions of said hem flange lie intersect at a hinge joint, the hinge assembly further comprising:

a rigid bracket member, the rigid bracket member having an upper flange portion and a lower hinge attachment portion opposite the upper flange portion, the flange portion having fastening means receiving structure for secure attachment to the support structure;

a hinge structure, the hinge structure having first and second rigid wing members, the first and second rigid wing members jointed about a substantially vertical axis of rotation, said first rigid wing member being integrally attached to said flanged member, said second rigid wing member having platform fastening means receiving structure for attachment to said platform;

bracket fastening means securely attaching upper bracket member to said superior support structure;

platform fastening means securely attaching said second rigid wing member to said platform, thus allowing said platform to be spatially repositioned about the substantially vertical axis of rotation at least 90 rotational degrees for easy ingress and egress through said watercraft hatch at the election of the occupant.

17. The environmental control system of claim 16, wherein said suspension means further comprises:

an upwardly extending positioning bracket integrally formed with said platform;

a mounting bracket, the mounting bracket having a superior bracket end and an inferior bracket end, the superior bracket end being securely attached to support structure adjacent said watercraft hatch, the inferior bracket end having positioning bracket attachment means for releasable attachment to the positioning bracket, the positioning bracket attachment means being releasably attached to said positioning bracket, thus allowing said positioning bracket to releasably retain said platform in position inferior to said watercraft hatch for easy ingress and egress through said watercraft hatch at the election of the occupant.

18. The environmental control system of claim 5 wherein said suspension means is further defined by two laterally opposed mounting brackets, each mounting bracket having a superior mounting flange portion and an inferior sliding flange receiving portion, each superior mounting flange portion having mounting bracket fastening means receiving structure for secure attachment to support structure adjacent said watercraft hatch.

19. The environmental control system of claim 18 wherein said hem flange has two oppositely aligned sliding flange portions, each sliding flange portion being supported by an upwardly extending flange support wall, each flange support wall being an upward extension of said hem flange, the sliding flange portions being releasably and slidably engaged with the inferior sliding flange receiving portions, thus allowing said platform to be releasably and slidably positioned inferior to said watercraft hatch for easy ingress and egress through said watercraft hatch at the election of the occupant.

20. The environmental control system of claim 5 wherein said suspension means is further defined by at least two flexible hanging members located opposite one another, each flexible hanging member having a superior attachment end and at least one inferior attachment end, each superior attachment end having support structure attachment means for attachment to support structure adjacent said watercraft hatch, the support structure attachment means being removably attached to support structure adjacent said watercraft hatch, each inferior attachment end having platform attachment means for attaching each inferior end to said platform, the platform attachment means being removably attached to said platform, thus allowing said platform to be releasably hung in position inferior to said watercraft hatch for easy ingress and egress through said watercraft hatch.

21. The environmental control system of claim 5 wherein said water diversion tube is translucent.

22. The environmental control system of claim 5 wherein said water collection and containment structure is a watercraft bilge.

23. The environmental control system of claim 16 wherein said conduit union is located adjacent said hinge assembly.

24. The environmental control system of claim 5 further comprising baffle means supported at the perimeter of said platform, the baffle means being manually adjustable for preventing wind blown rain from escaping said platform through the opening between said platform and the underside of said watercraft hatch.

25. An environmental control system for use in combination with a vehicular ceiling hatch comprising, in combination:

a vehicular ceiling hatch, the vehicular ceiling hatch being spatially and fixedly positioned in a substantially horizontal plane, said vehicular ceiling hatch being adjacent support structure, said vehicular ceiling hatch having pre-selected horizontal hatch size dimensions;

a platform, the platform being suspended below the vehicular ceiling hatch, said platform being adapted to support matter inferior to said vehicular ceiling hatch, said platform further comprising:

a substantially planar portion, the planar portion having an upper support surface and a lower exposed surface, the upper support surface facing opposite said vehicular ceiling hatch, the lower exposed surface facing a floor surface opposite said vehicular ceiling hatch;

an upwardly extending contiguous hem flange about the perimeter of said planar portion; the hem flange having an inner retaining surface and an outer exposed surface, said hem flange having at least one liquid outlet aperture for exhausting liquid from said upper support surface through said inner retaining surface and said outer exposed surface;

at least one suspension means for suspending said platform below said vehicular ceiling hatch, the suspension means having at least one spatially superior attachment structure and at least one spatially inferior attachment structure opposite the spatially superior attachment structure, the spatially superior attachment structure being attached to support structure adjacent said vehicular ceiling hatch, the spatially inferior attachment structure being attached to said platform;

at least one water conduit structure for diverting water away from said platform, the water conduit structure having one water inlet end and at least one water outlet end opposite the water inlet end, said water inlet end being cooperatively associated with the water outlet aperture for receiving exhausted water from said liquid outlet aperture; and at least one water collection and containment structure for receiving and containing exhausted water, the water collection and containment structure having at least one water receiving aperture, the water receiving aperture being cooperatively associated with the water outlet end for receiving exhausted water from said water outlet end.

26. The environmental control system of claim 25 wherein said planar portion lies in a plane substantially parallel to the plane in which said vehicular ceiling hatch lies.

27. The environmental control system of claim 26 wherein said planar portion has pre-selected hem perimeter dimensions of greater magnitude than the pre-selected hatch perimeter dimensions such that the difference therebetween results in a suspended margin of perimeter overlap, the suspended margin of perimeter overlap having an inner perimeter and an outer perimeter.

28. The environmental control system of claim 27 wherein the perpendicular distance between the inner perimeter and the outer perimeter is substantially constant.

29. The environmental control system of claim 28 wherein the pre-selected hem perimeter dimensions are dependent on the distance between the plane in which said planar portion lies and the plane in which said vehicular ceiling hatch lies.

30. The environmental control system of claim 29 wherein a substantially positive correlation exists between the perpendicular distance between said inner perimeter and said outer perimeter and the distance between the plane in which said planar portion lies and the plane in which said vehicular ceiling hatch lies.

31. The environmental control system of claim 30 wherein the substantially positive correlation varies in about a one unit to one unit ratio.

32. The environmental control system of claim 25 further comprising baffle means supported at the perimeter of said platform, the baffle means being manually adjustable for preventing wind blown rain from escaping said platform through the opening between said platform and the underside of said vehicular ceiling hatch.

33. An environmental control system for use in combination with a ceiling hatch comprising, in combination:

a ceiling hatch, the ceiling hatch being spatially and fixedly positioned in a substantially horizontal plane, said ceiling hatch being adjacent support structure, said ceiling hatch having pre-selected horizontal hatch-size dimensions;

a platform, the platform being suspended below the ceiling hatch, said platform being adapted to support matter inferior to said ceiling hatch, said platform further comprising:

a substantially planar portion, the planar portion having an upper support surface and a lower exposed surface, the upper support surface facing opposite said ceiling hatch, the lower exposed surface facing a floor surface opposite said ceiling hatch;

an upwardly extending contiguous hem flange about the perimeter of said planar portion; the hem flange having an inner retaining surface and an outer exposed surface, said hem flange having at least one liquid outlet aperture for exhausting liquid from said upper support surface through said inner retaining surface and said outer exposed surface;

at least one suspension means for suspending said platform below said ceiling hatch, the suspension means having at least one spatially superior attachment structure and at least one spatially inferior attachment structure opposite the spatially superior attachment structure, the spatially superior attachment structure being attached to support structure adjacent said ceiling hatch, the spatially inferior attachment structure being attached to said platform;

at least one liquid conduit structure for diverting liquid away from said platform, the liquid conduit structure having one liquid inlet end and at least one liquid outlet end opposite the liquid inlet end, said liquid inlet end being cooperatively associated with the liquid outlet aperture for receiving exhausted liquid from said liquid outlet aperture; and at least one liquid collection and containment structure for receiving and containing exhausted water, the liquid collection and containment structure having at least one liquid receiving aperture, the liquid receiving aperture being cooperatively associated with the liquid outlet end for receiving exhausted liquid from said liquid outlet end.

34. The environmental control system of claim 33 wherein said planar portion lies in a plane substantially parallel to the plane in which said ceiling hatch lies.

35. The environmental control system of claim 34 wherein said planar portion has pre-selected hem perimeter dimensions of greater magnitude than the pre-selected hatch perimeter dimensions such that the difference therebetween results in a suspended margin of perimeter overlap, the suspended margin of perimeter overlap having an inner perimeter and an outer perimeter.

36. The environmental control system of claim 35 wherein the perpendicular distance between the inner perimeter and the outer perimeter is substantially constant.

37. The environmental control system of claim 36 wherein the pre-selected hem perimeter dimensions are dependent on the distance between the plane in which said planar portion lies and the plane in which said ceiling hatch lies.

38. The environmental control system of claim 37 further comprising baffle means supported at the perimeter of said platform, the baffle means being manually adjustable for preventing wind blown rain from escaping said platform through the opening between said platform and the underside of said ceiling hatch.

* * * * *